US008609584B2

(12) United States Patent
Sawada

(10) Patent No.: US 8,609,584 B2
(45) Date of Patent: Dec. 17, 2013

(54) THERMAL TRANSFER SHEET

(75) Inventor: Masakazu Sawada, Kanagawa (JP)

(73) Assignee: Sony Corporation, Tokyo (JP)

( * ) Notice: Subject to any disclaimer, the term of this patent is extended or adjusted under 35 U.S.C. 154(b) by 69 days.

(21) Appl. No.: 13/354,679

(22) Filed: Jan. 20, 2012

(65) Prior Publication Data

US 2012/0189787 A1 Jul. 26, 2012

(30) Foreign Application Priority Data

Jan. 26, 2011 (JP) ..... P2011-014309

(51) Int. Cl.
*B41M 5/382* (2006.01)

(52) U.S. Cl.
USPC ..... 503/227

(58) Field of Classification Search
USPC ..... 503/227
See application file for complete search history.

(56) References Cited

U.S. PATENT DOCUMENTS 6,232,267 B1 * 5/2001 Oshima et al. ..... 503/201
6,498,123 B2 12/2002 Suzuki et al.
8,129,310 B2 * 3/2012 Yokozawa ..... 503/227
8,236,728 B2 * 8/2012 Yokozawa ..... 503/227
8,343,889 B2 * 1/2013 Yamashita et al. ..... 503/227
2011/0045213 A1 2/2011 Ieshige et al.

FOREIGN PATENT DOCUMENTS

JP 2008-105373 5/2008
JP 2001-334760 12/2011

* cited by examiner

*Primary Examiner* — Bruce H Hess
(74) *Attorney, Agent, or Firm* — Frommer Lawrence & Haug LLP; William S. Frommer; Joseph W. Treloar

(57) ABSTRACT

There is provided a thermal transfer sheet including a thermal transfer dye layer formed on one surface of a base sheet and containing a dye and a heat resistant smooth layer formed on the other surface of the base sheet and containing a binder, a lubricant, and a filler. The binder contained in the heat resistant smooth layer is obtainable by mixing a polyvinyl acetoacetal resin with an acryl silicone resin which has a mass average molecular weight of 100,000 or more and is in the form of a powdery solid at an ordinary temperature at a ratio of 10 parts by mass or less of the acryl silicone resin relative to 100 parts by mass of the polyvinyl acetoacetal resin, and the heat resistant smooth layer further contains 10 parts by mass or more and 30 parts by mass or less of isocyanate relative to 100 parts by mass of the polyvinyl acetoacetal resin and phosphoric acid ester having a melting point of 50° C. or more as the lubricant.

2 Claims, 6 Drawing Sheets

THERMAL TRANSFER SHEET

BACKGROUND

The present disclosure relates to a thermal transfer sheet, particularly, to a component forming a heat resistant smooth layer provided in the thermal transfer sheet.

A thermal transfer method using a sublimation dye is employed for reproducing a full-color image by color dots of a multiple of colors by transferring the multiple of color dots onto a material to which the color dots are to be transferred by heating for a remarkably short time. In the thermal transfer method, a so-called sublimation type thermal transfer sheet in which a dye layer including the sublimation dye and a binder is provided on one surface of a base sheet such as a polyester film is used as a thermal transfer sheet.

Further, in the thermal transfer method, the thermal transfer sheet is heated from a back thereof by a heating unit such as a thermal head according to image information, and an image is formed by transferring a dye contained in the dye layer onto a material (printing paper) to which the dye is to be transferred. It is necessary that a friction between a surface of the thermal transfer sheet contacting the thermal head and the thermal head is stably low from a low density printing to a high density printing. Therefore, in the thermal transfer sheet in general, a heat resistant smooth layer is provided on a surface which is the other side of the surface on which the dye layer is formed for the purposes of preventing fusion with the thermal head and imparting good running smoothness (smoothing property).

For a heat resistant smooth layer, a method of forming a layer formed of a thermally crosslinkable resin is often employed for the purpose of imparting heat resistance to a base sheet, and it is possible to impart abrasion resistance and heat resistance to a thermal transfer sheet by the method. Though it is possible to obtain the heat resistant smooth layer having good heat resistance by employing the method, it is difficult to impart smoothness only by the thermally crosslinkable resin binder. Further, since the process is complicated due to the necessity of performing an aging treatment (heat curing) at 50° C. for about one week for the thermal crosslinking, a considerably long production time is incurred in the end.

As a method for solving the above-described issue, a method of using a mixture of polyamideimide and polyamideimide silicone as a binder has been proposed (see Japanese Patent Application Laid-Open No. 2001-334760, for example). In the case where the above-described binder is used, since the polyamideimide and polyamideimide silicone have Tg of 200° C. or more, it is possible to impart heat resistance to the thermal transfer sheet. Further, in the case where the binder is used, since it is possible to impart smoothness by an action of a silicone unit of the polyamideimide silicone, it is possible to obtain a good heat resistant smooth layer without heat curing.

Further, as another method for solving the issue, a method of using a cellulose acetate butyrate resin as the binder for the heat resistant smooth layer has been proposed (see Japanese Patent Application Laid-Open No. 2008-105373, for example). In Japanese Patent Application Laid-Open No. 2008-105373, a method of adding an acryl silicone resin is exemplified in Examples.

SUMMARY

However, in the case of using the polyamideimide and polyamideimide silicone as the binder as in Japanese Patent Application Laid-Open No. 2001-334760, a higher cost is incurred due to the use of the polyimide material. Further, since adhesion of polyamideimide and polyamideimide silicone to the base sheet is poor, powder generation can occur, and coating film stability is insufficient. Further, in the case where the polyamideimide and polyamideimide silicone are used as the binder, it is necessary to pay attention to drying conditions since a coating film is easily bleached during drying.

Further, when coating the polyamideimide, an organic solvent for dissolving polyamide is limited. As a result, additives to be used as components of the heat resistant smooth layer are limited in some cases.

Further, in the case of imparting smoothness and a thermal head polishing property (contamination preventing property) to the heat resistant smooth layer, a lubricant and a filler are sometimes added to the heat resistant smooth layer. In the case of maintaining these additives in a dispersed state, single use of polyamide which does not have an absorption group or an active spot is disadvantageous and entails insufficient dispersibility and tendency of easy aggregation of the additives.

Further, since the acryl silicone resin used in Examples of Japanese Patent Application Laid-Open No. 2008-105373 has a low weight average molecular weight, eat resistance is insufficient. Further, since the acryl silicone resin contains a non-reacted substance attributable to synthesis, the resin lacks storage stability in the case of contact with a dye layer. Further, since the acryl silicone resin contains a multiple of OH groups or COOH groups in molecule, the acryl silicone resin can absorb moisture and, therefore, lacks the storage stability.

In light of the foregoing, it is desirable to provide a thermal transfer sheet which does not require an aging treatment of a heat resistant smooth layer, stably has excellent running smoothness within a range of temperatures of heating the thermal transfer sheet by a heating unit, and is excellent in dye storage stability and a heating unit contamination prevention property.

According to an embodiment of the present invention, there is provided a thermal transfer sheet including a thermal transfer dye layer formed on one surface of a base sheet and containing a dye and a heat resistant smooth layer formed on the other surface of the base sheet and containing a binder, a lubricant, and a filler. The binder contained in the heat resistant smooth layer is obtainable by mixing a polyvinyl acetoacetal resin with an acryl silicone resin which has a mass average molecular weight of 100,000 or more and is in the form of a powdery solid at an ordinary temperature at a ratio of 10 parts by mass or less of the acryl silicone resin relative to 100 parts by mass of the polyvinyl acetoacetal resin, and the heat resistant smooth layer further contains 10 parts by mass or more and 30 parts by mass or less of isocyanate relative to 100 parts by mass of the polyvinyl acetoacetal resin and phosphoric acid ester having a melting point of 50° C. or more as the lubricant.

The filler of the heat resistant smooth layer may contain spherical particles containing polymethyl silsesquioxane or a mixture of the spherical particles containing polymethyl silsesquioxane and talc which is tabular particles.

According to the present disclosure, it is possible to obtain a thermal transfer sheet which does not require an aging treatment of a heat resistant smooth layer, stably has excellent running smoothness within a range of temperatures of heating the thermal transfer sheet by a heating unit, and is excellent in dye storage stability and a heating unit contamination prevention property by adding a binder obtainable by mixing a polyvinyl acetal resin and an acryl silicone resin which is in the form of a powder at an ordinary temperature in the heat resistant smooth layer, adding isocyanate as a crosslinking agent, and adjusting an amount of the isocyanate to be added to an amount which enables to complete a crosslinking reaction of the binder resins in a coating and drying process.

DETAILED DESCRIPTION OF THE EMBODIMENTS

Figure 1:
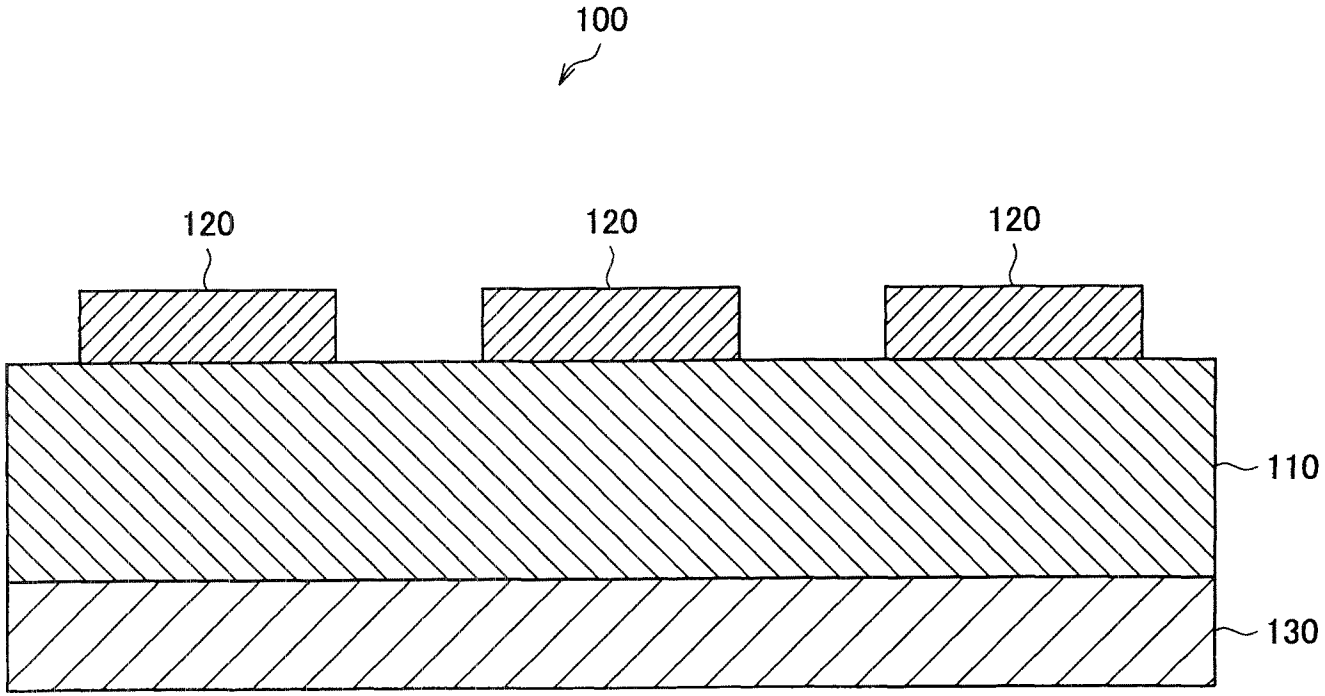
FIG. 1 is a sectional view schematically showing one configuration example of a thermal transfer sheet according to one preferred embodiment of the present disclosure.

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

Description will be given in the following order.

1. Configuration of Thermal Transfer Sheet
1-1. Base sheet 110
1-2. Dye Layer 120
1-3. Detection Mark Layer 140, Transfer Protecting Layer 150, Transfer Receiving Layer 160, etc.
1-4. Heat Resistant Smooth layer 130
2. Method for Producing Thermal Transfer Sheet <1. Configuration of Thermal Transfer Sheet>

Figure 2:
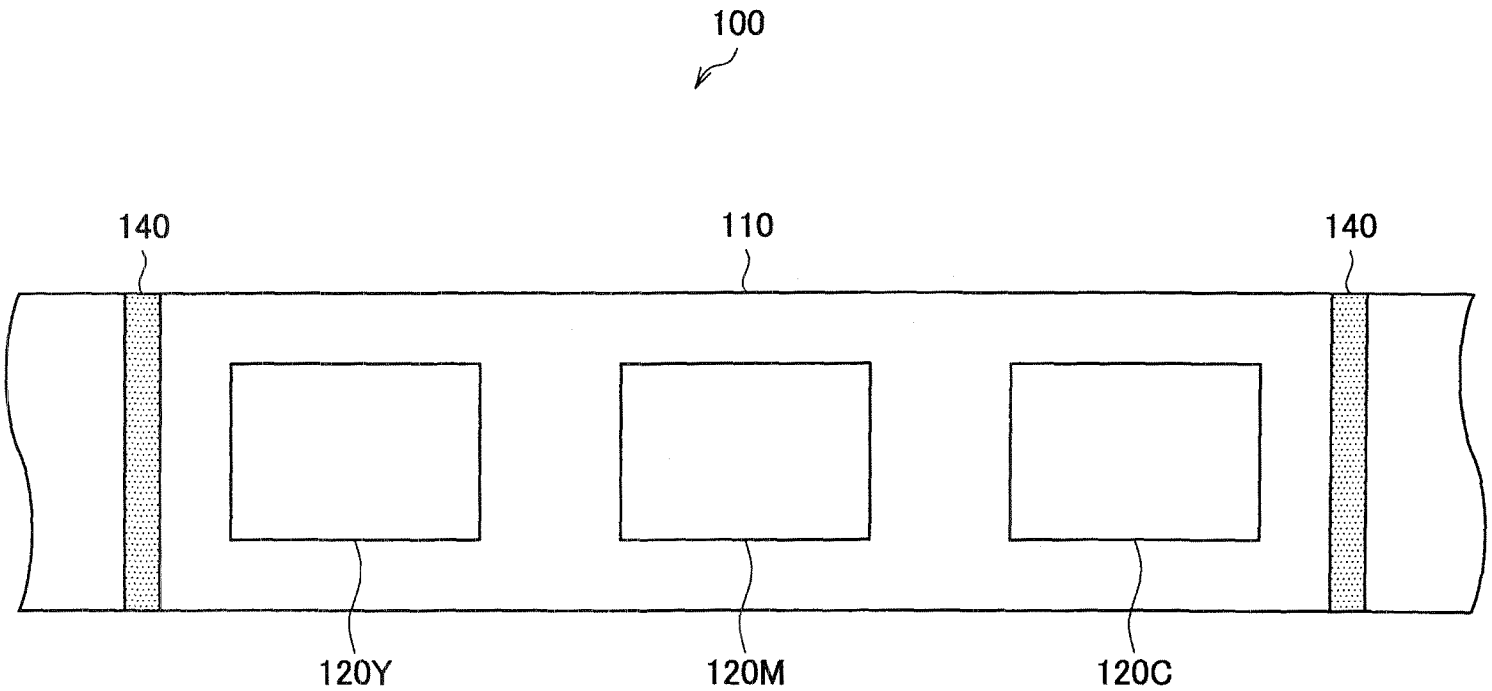
FIG. 2 is a plan view schematically showing another configuration example of the thermal transfer sheet according to the embodiment.
Figure 3:
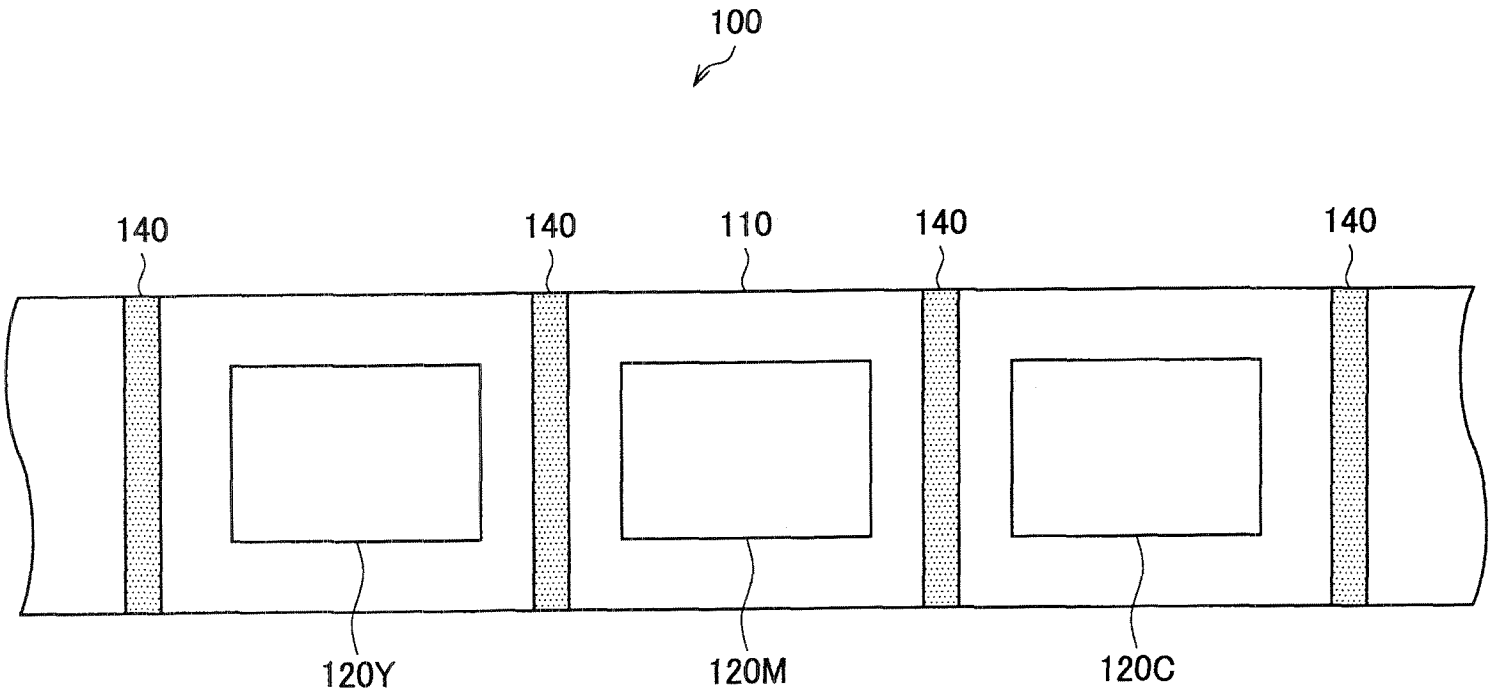
FIG. 3 is a plane view schematically showing one configuration example of the thermal transfer sheet in which a detection mark layer is provided between dye layers.
Figure 4:
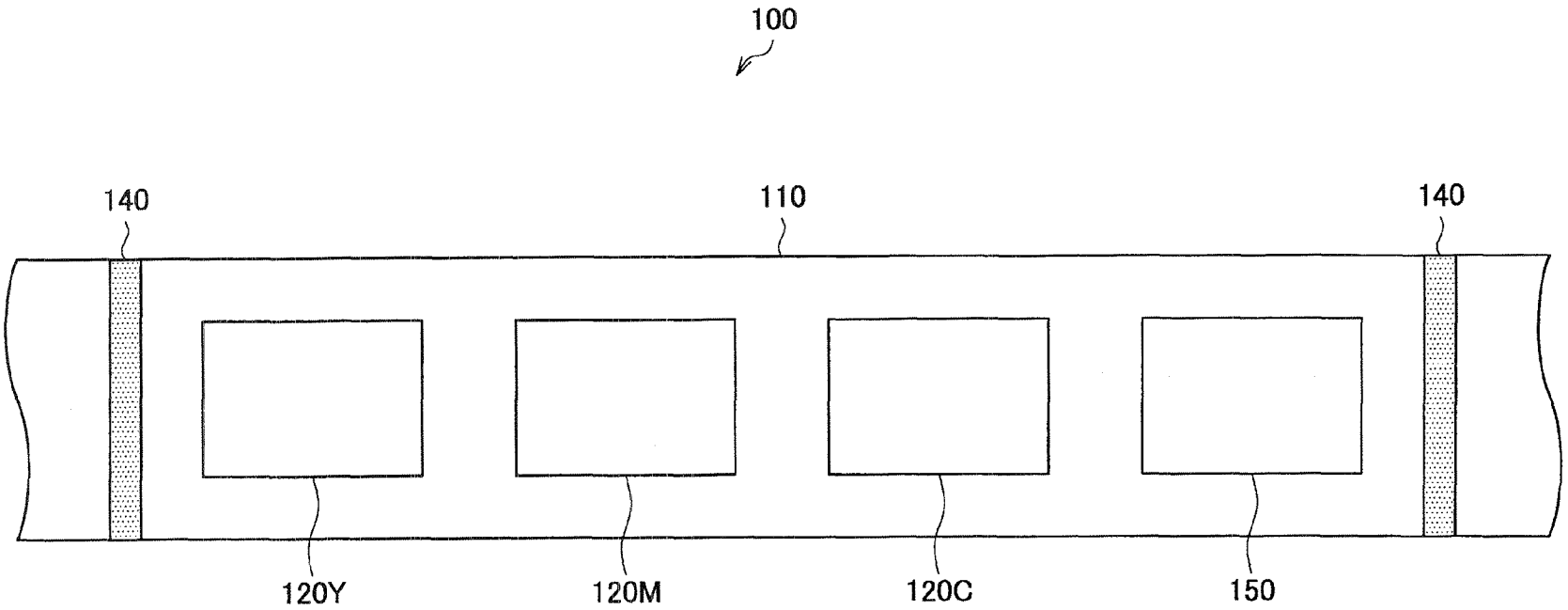
FIG. 4 is a plan view schematically showing one configuration example of the thermal transfer sheet in which a transfer protecting layer is provided.
Figure 5:
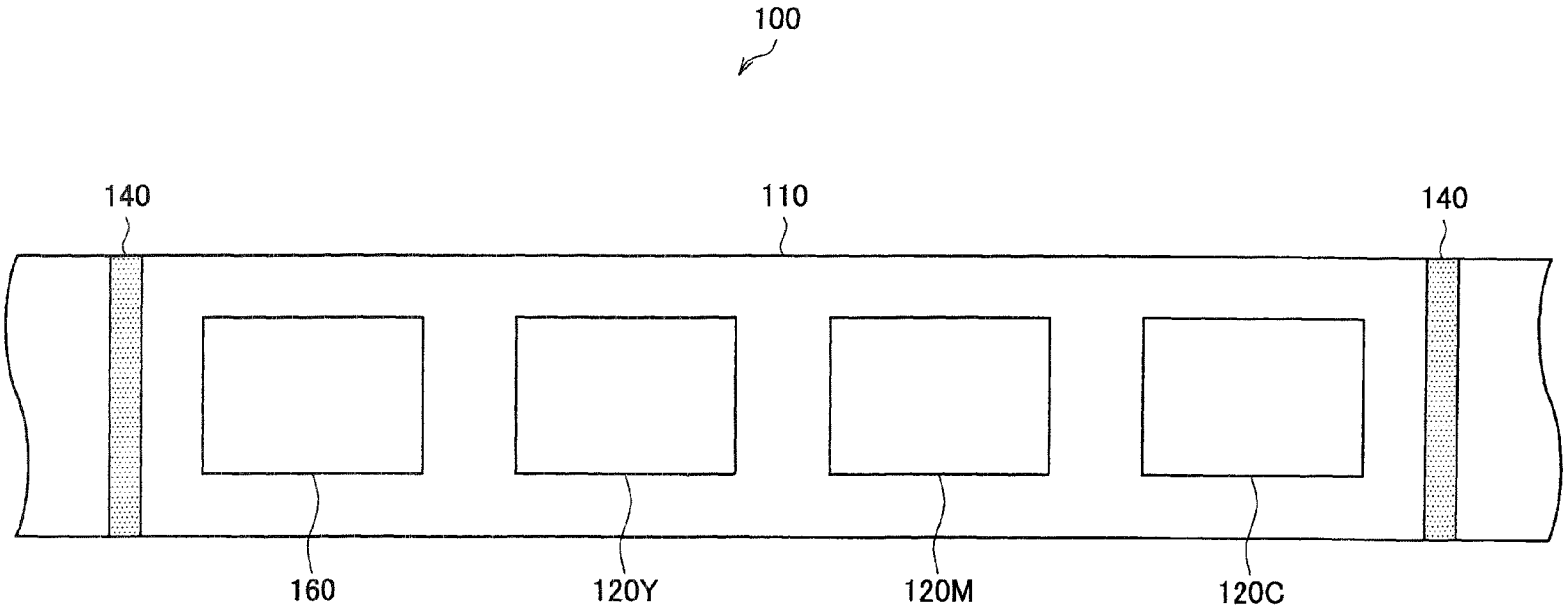
FIG. 5 is a plan view schematically showing one configuration example of the thermal transfer sheet in which a transfer receiving layer is provided.

With reference to FIGS. 1 to 5, a configuration of a thermal transfer sheet according to one preferred embodiment of the present disclosure will be described. FIG. 1 is a sectional view schematically showing one configuration example of a thermal transfer sheet according to the preferred embodiment of the present disclosure. FIG. 2 is a plan view schematically showing another configuration example of the thermal transfer sheet according to the embodiment. FIG. 3 is a plane view schematically showing one configuration example of the thermal transfer sheet according to the embodiment in which a detection mark layer is provided between dye layers. FIG. 4 is a plan view schematically showing one configuration example of the thermal transfer sheet according to the embodiment in which a transfer protecting layer is provided. FIG. 5 is a plan view schematically showing one configuration example of the thermal transfer sheet according to the embodiment in which a transfer receiving layer is provided.

As shown in FIG. 1, a thermal transfer sheet 100 according to the present embodiment includes a base sheet 110 which is a strip-like substrate, a thermal transfer dye layer 120 (hereinafter sometimes referred to as "dye layer 120") formed on one surface of the base sheet 110, and a heat resistant smooth layer 130 formed on the other surface of the base sheet 110.

[1-1. Base Sheet 110]

For the base sheet 110, various substrates having heat resistance and strength of certain degrees are usable. More specifically, as the base sheet 110, a polyester film, a polystyrene film, a polypropylene film, a polysulfone film, a polycarbonate film, a polyimide film, an aramid film, or the like may be used, for example. A thickness of the base sheet 110 may arbitrarily be decided and may be 1 to 30 μm, preferably 2 to 10 μm, for example.

[1-2. Thermal Transfer Dye Layer 120]

The thermal transfer dye layer 120 is formed on the surface opposed to a printing paper of the base sheet 110. The thermal transfer dye layer 120 is formed on an entire part of the surface of the base sheet 110 as a continuous layer in the case of use for a single-color image. In the case of use for a full-color image, in general, dye layers 120Y, 120M, and 120C for colors of yellow (Y), magenta (M), and cyan (C) are separately and repeatedly formed on the base sheet 110. The order of formation of the dye layers 120Y, 120M, and 120C for the colors of yellow, magenta, and cyan is not necessarily the same as that shown in FIG. 2. Further, in the case of the use for full-color image, dye layers 120 for four colors of yellow (Y), magenta (M), cyan (C), and black (B) may be repeatedly formed.

The thermal transfer dye layer 120 is formed of at least the color dyes and binders carrying the dyes.

(Dye)

As the dye to be contained in the thermal transfer dye layer 120, an arbitrary material may be used insofar as the material is a dye which is molten, diffused, or capable of sublimation migration by heat. For example, as the yellow dye, a dye such as azo-based, disazo-based, methine-based, and pyridoneazo-based dyes or a mixture dye thereof may be used. As the magenta dye, a dye such as azo-based, anthraquinone-based, styryl-based, and heterocyclic azo-based dyes or a mixture dye thereof may be used. As the cyan dye, a dye such as indoaniline-based, anthraquinone-based, naphthoquinone-based, and heterocyclic azo-based dyes or a mixture dye thereof may be used. The dyes to be added to the thermal transfer dye layer 120 are decided by taking properties of the dyes, such as a color phase, a printing density, light resistance, storability, and solubility to binder into consideration.

(Binder)

As a binder to be used for forming the thermal transfer dye layer 120, an arbitrary material may be used. More specifically, examples of a binder for the thermal transfer dye layer 120 include an aquaresin such as cellulose-based, acrylic acid-based, and starch-based water-soluble resins; an organic solvent such as an acryl resin, polyphenylene oxide, polysalfone, polyether sulfone, and acetylcellulose, a water-soluble resin, and the like. Among these, those having a heat deflection temperature (JIS K7191) of 70° C. to 150° C. are excellent as the binder from the viewpoints of recording sensitivity and transfer body storage stability. Therefore, as the binder for the thermal transfer dye layer 120, polystyrene, polyvinyl butyral, polycarbonate, a methacryl resin, an acrylonitrile/styrene copolymer, a polyester resin, a urethane resin, polyethylene chloride, polypropylene chloride, and the like are preferred.

As a mass ratio between the dye and the binder in the dye layer 120, a value typically used for the dye layer of the thermal transfer sheet, such as 30 to 300 parts by mass of the dye relative to 100 parts by mass of the binder when dried, may be adopted.

[1-3. Detection Mark Layer 140, Transfer Protecting Layer 150, Transfer Receiving Layer 160, etc.]

In the thermal transfer sheet 100 according to the present embodiment, a detection mark layer 140, a transfer protecting layer 150, and a transfer receiving layer 160 may further be formed on the surface of the base sheet 110 on which the thermal transfer dye layer 120 is formed.

(Detection Mark Layer 140)

The detection mark layer 140 is a layer which is provided so that a printer performing thermal transfer can detect positions of the dye layer 120, the transfer protecting layer 150, the transfer receiving layer 160, and the like. In the case where the yellow color dye layer 120Y, the magenta color dye layer 120M, and the cyan color dye layer 120C are considered as a group of dye layers, the detection mark layer 140 may be provided between the adjacent groups of dye layers as shown in FIG. 2. More specifically, the detection mark layer 140, the yellow color dye layer 120Y, the magenta color dye layer 120M, and the cyan color dye layer 120C are repeatedly formed in this order on one surface of the base sheet 110 in this case. Further, the detection mark layer 140 may be provided between the adjacent color dye layers 120 as shown in FIG. 3, for example.

(Transfer Protecting Layer 150)

The transfer protecting layer 150 is a layer which is transferred onto a printing surface after printing and protects the printing surface in the case where light resistance, scratch resistance, chemical resistance, and the like of the printed matter are insufficient. The transfer protecting layer 150 is formed from a known material which is capable of protecting the printing surface, such as an organic polymer including an acryl resin, a polystyrene resin, a polyester resin, and the like, for example. Further, the transfer protecting layer 150 is provided after the group of dye layers of the yellow color dye layer 120Y, magenta color dye layer 120M, and cyan color dye layer 120C (at a side which contacts the printing paper later) as shown in FIG. 4, for example, in order to protect the printing surface after transfer of the color dyes, i.e. after the printing on a printing paper.

(Transfer Receiving Layer 160)

The transfer receiving layer 160 is provided in the case where a material onto which the dye layer 120 is to be transferred is a medium onto which it is difficult to directly transfer the dye layer 120, such as an ordinary paper or the like, and is transferred onto the material before the thermal transfer dye layers 120 are transferred. The transfer receiving layer 160 is formed of a known material onto which the dye can be transferred, and it is preferable to use the known material to which the dye is readily fixed. Further, in order that the transfer receiving layer 160 forms a receiving layer on a surface of the material such as an ordinary paper in advance of the transfer of the thermal transfer dye layer 120, the transfer receiving layer 160 is provided before the group of dye layers of the yellow color dye layer 120Y, magenta color dye layer 120M, and cyan color dye layer 120C (at a side which contacts the material first) as shown in FIG. 4, for example.

(Other Layers)

A primer layer (not shown) which reinforces adhesion between the above-described dye layer 120, detection mark layer 140, transfer protecting layer 150, and transfer receiving layer 160 and the base sheet 110 may be provided between the above-described layers and the base sheet 110 on the surface of the base sheet 110 opposed to the printing paper. Further, a known adhesion treatment such as a Colona discharge treatment, a flame treatment, and an ozone treatment may be performed in place of the formation of primer layer.

[1-4. Heat Resistant Smooth Layer 130]

The heat resistant smooth layer 130 is formed on the surface of the base sheet 110 which is reverse to the surface on which the thermal transfer dye layer 120 is formed (i.e. the surface opposed to the printing paper). When the thermal transfer dye layer 120 is transferred, the thermal transfer sheet 100 runs with the surface of the base sheet 110, which is the surface reverse to the surface opposed to the printing paper, contacting the heating unit such as the thermal head. Therefore, the heat resistant smooth layer 130 is provided for the purposes of diminishing the friction between the thermal transfer sheet 100 and the heating unit and improving running smoothness of the contact running by imparting lubricity to the base sheet 110.

The heat resistance smooth layer 130 contains a binder, a lubricant, and a filler.

(Binder)

As the binder to be used for forming the heat resistant smooth layer 130, a binder obtainable by mixing a polyvinyl acetoacetal resin and an acryl silicone resin is used. In view of compatibility of the resins and performance of the heat resistant smooth layer, the combination of polyvinyl acetoacetal resin with acryl silicone resin is preferred. For example, when resins of poor compatibility are mixed, it is difficult to obtain a homogeneous coating layer, and a friction tends to be increased, thereby exerting adverse influence on running smoothness of the thermal transfer sheet.

The polyvinyl acetoacetal resin is used since the resin has Tg of 100° C. or more and is capable of imparting excellent heat resistance to the heat resistant smooth layer 130. Therefore, among polyvinyl acetal resins, a polyvinyl butyral resin and the like, for example, are not included. By imparting heat resistance as much as possible to the heat resistant smooth layer 130 as described above, it is possible to prevent migration of a dye or a lubricant in the case of contact with the thermal transfer dye layer 120. Further, as the binder for the heat resistant smooth layer 130, not only a binder using one type of polyvinyl acetoacetal resin, but also a binder in which two or more types of polyvinyl acetoacetal resins having different molecular weights are mixed may be used for the purpose of adjusting viscosity in coating. In the case of mixing two or more types of polyvinyl acetoacetal resins, a mixing ratio is not particularly limited.

It is possible to synthesize the acryl silicone resin which is mixed with the polyvinyl acetoacetal resin through a copolymerization reaction between a polysiloxane group-containing vinyl monomer and an acrylic acid ester monomer, or a reaction between an acryl resin and reactive silicone, or the like, for example.

As the acryl silicone resin for the heat resistant smooth layer 130, those which are a solid at an ordinary temperature and have a molecular weight of 100,000 or more may be used. As used herein, "solid at an ordinary temperature" means a state of being in the form of a solid without softening and elution at 15° C. to 30° C. The resin which can be in the form of a liquid or a wax at the ordinary temperature causes the dye to easily migrate when the heat resistant smooth layer 130 and the dye layer 120 are brought into contact with each other, thereby causing a color shift. Further, since the aging treatment is not necessary in the formation of the heat resistant smooth layer 130 in the present embodiment, it is necessary to sufficiently polymerize the acryl silicone resin in advance of the formation. Therefore, a mass average molecular weight of the acryl silicone resin to be used for the heat resistant smooth layer 130 is 100,000 or more. When the mass average molecular weight of the acryl silicone resin is less than 100,000, it is difficult to attain satisfactory film strength of the heat resistant smooth layer 130, and it is difficult to use the acryl silicone resin having the mass average molecular weight of less than 100,000 as the binder, thereby causing the necessity of thermal crosslinking or the like. Since solubility of a resin is generally reduced along with an increase in molecular weight, it is preferable to set the mass average molecular weight of the acryl silicone resin in view of a degree of polymerization and solubility of the resin.

The acryl silicone resin to be used for the heat resistant smooth layer 130 may preferably have a low hydroxide group value and a low acid value. A high hydroxide group value and a high acid value indicate the presence of many residual COOH groups and OH groups. Therefore, when an acryl silicone resin having high hydroxide group value or high acid value is used for the heat resistant smooth layer 130, the heat resistant smooth layer 130 easily absorbs moisture and tends to be subject to friction variation.

It is preferable that impurities (e.g. low molecular polymer or oligomer) which are attributable to the synthesis are removed as much as possible. When the acryl silicone resin in which the impurities are present is used for the heat resistant smooth layer 130, the dye tends to migrate when the heat resistant smooth layer 130 and the dye layer 120 are in contact with each other, and there is a risk of fusion with a heating unit such as a thermal head when the thermal transfer sheet 100 is subjected to running for repetitive printing. As a cleaning method for removing the impurities from the acryl silicone resin, various methods such as solvent washing, recrystallization, and filtration are known, and the method is not particularly limited. In the case where the acryl silicone resin is synthesized by a copolymerization reaction between a polysiloxane group-containing vinyl monomer and an acrylic acid ester monomer, a polymerization reaction is performed in a solvent, and a solid matter concentration adjustment is ordinarily performed with the use of the solvent without performing any washing step. However, since non-reacted substances and byproducts are left to be present when the synthesis method is employed, it is necessary to remove the impurities. More specifically, as an amount of impurities in the acryl silicone resin, 5 mass % or less is preferred.

A content of the acryl silicone resin in the heat resistant smooth layer 130 is 10 parts by mass or less relative to 100 parts by mass of the polyvinyl acetoacetal resin. When the acryl silicone resin is contained in an amount exceeding 10 parts by mass, compatibility with the polyvinyl acetoacetal resin is deteriorated, and a friction is increased. Further, when the acryl silicone resin is contained in an amount more than necessary, heat resistance is deteriorated to increase an amount of transfer (migration) of the dye to the heat resistant smooth layer 130. On the other hand, a smallest amount of the acryl silicone resin to be used is not particularly limited, and a great friction diminishing effect is attained with a small amount of the acryl silicone resin. The smallest amount of the acryl silicone resin may preferably be 0.1 part by mass or more relative to 100 parts by mass of the polyvinyl acetoacetal resin.

(Crosslinking by Isocyanate)

It is necessary to crosslink the binder resin with the use of isocyanate for the heat resistant smooth layer 130 according to the present embodiment. When isocyanate is not used, the aging treatment, i.e. a heat curing treatment for curing a film by heating after applying a coating liquid for forming the heat resistant smooth layer 130, is not necessary. However, since the use of isocyanate enables to prevent the transfer of the dye to the heat resistant smooth layer 130, and since this effect is a preferable feature of isocyanate which is not observed with other materials, isocyanate is used in the present embodiment.

An arbitrary isocyanate may be used without particular limitation to a type of isocyanate usable for the heat resistant smooth layer 130, and any one of isocyanate compounds is suitably used insofar as the polyisocyanate compound has at least two or more isocyanate groups in molecule. Specific examples of the polyisocyanate compound include tolylene diisocyanate, 4,4'-diphenylmethane diisocyanate, 4,4'-xylene diisocyanate, hexamethylene diisocyanate, 4,4'-methylenebis(cyclohexylisocyanate), methylcyclohexane-2,4-diisocyanate, methylcyclohexane-2,6-diisocyanate, 1,3-di(isocyanatemethyl)cyclohexane, isophorone diisocyanate, trimethyl/hexamethylene diisocyanate, and the like, an adduct (polyisocyanate prepolymer) obtainable by a partial addition reaction between diisocyanate and polyol, such as an adduct obtained by a reaction between tolylene diisocyanate and trimethylolpropane, and the like. Among these polyisocyanate compounds, the adduct of tolylene diisocyanate and trimethylolpropane and an adduct of 4,4'-xylene diisocyanate and trimethylolpropane are more preferred from the viewpoint of a reaction speed.

The isocyanate to be used for the heat resistant smooth layer 130 may preferably be in an amount which enables to complete the crosslinking reaction in a drying step after coating the coating liquid onto the base sheet. More specifically, a content of the isocyanate in the heat resistant smooth layer 130 is 10 parts by mass or more and 30 parts by mass or less relative to 100 parts by mass of the polyvinyl acetoacetal resin. With the use of the above-specified amount of the isocyanate, a film of the heat resistant smooth layer 130 is cured by drying at a drying temperature of about 90° C. to 120° C. for 10 to 40 seconds, thereby making it possible to complete the crosslinking reaction. In this case, the crosslinking reaction by the isocyanate readily progresses when high moisture is maintained during a step of applying the coating liquid for the heat resistant smooth layer 130. Further, since the progress of the crosslinking reaction is largely changed by an amount of blowing air by a drier used for the drying, it is preferable to appropriately optimize the air blowing amount of the drier.

(Lubricant)

Examples of the lubricant to be used for the heat resistant smooth layer 130 include poly glycerin fatty acid ester, phosphoric acid ester, fatty acid ester, fatty acid amide, and the like. Among these lubricants, the phosphoric acid ester may preferably be used, and acidic phosphoric acid ester may particularly preferably be used. The use of acidic phosphoric acid ester promotes the crosslinking reaction by isocyanate which is described later in this specification. Further, as the lubricant, a lubricant having a melting point of 50° C. or more, particularly, a lubricant containing phosphoric acid ester having a melting point of 50° C. or more, is used. When the melting point of the lubricant is low, film hardness of the heat resistant smooth layer 130 becomes insufficient to cause migration of the dye and the lubricant when the heat resistant smooth layer 130 contacts the dye layer 120, thereby causing a color shift, and the low melting point can be a factor for entailing blocking with the dye layer 120. A preferred amount of the lubricant to be added is not particularly limited and can appropriately be adjusted depending on friction of the binder.

(Filler)

As the filler to be used for the heat resistant smooth layer 130, a filler of spherical particles is usable. As the filler of spherical particles, an inorganic filler such as silica, titanium oxide, zinc oxide, and carbon and an organic filler such as a silicone resin, a teflon (registered trademark) resin, and a benzoguanamine resin are usable. Among these fillers of spherical particles, a silicone resin formed of polymethyl silsesquioxane is most preferred. As an average particle diameter of spherical particles of the silicone resin or the like, 0.5 μm or more and 5.0 μm or less is preferred. In the case where the particle diameter of the spherical particles is too small, it is difficult to project the filler from the surface of the heat resistant smooth layer 130, thereby making it difficult to impart a smoothing property. On the other hand, when the particle diameter of spherical particles is too large, it is difficult to transfer the heat of the heating unit such as the thermal head in printing. Further, when unevenness is formed on the surface of the heat resistant smooth layer 130 by using the spherical particles within the above-specified range of particle diameter, a contact area between the thermal transfer dye layer 120 and the heat resistant smooth layer 130 is reduced in the case where the thermal transfer sheet 100 is wound to be stored, thereby making it possible to prevent migration of the dye and improving the smoothing property. As used herein, the average particle diameter means a number average particle diameter of primary particles when measured by using a particle distribution meter.

Further, a filler of tabular particles may be used in combination with the filler of spherical particles for the heat resistant smooth layer 130. As the filler of tabular particles, an inorganic filler such as talc, clay, and mica and an organic filler such as those formed from a polyethylene resin are usable. Among these fillers of tabular particles, talc is most preferred from the viewpoint of hardness. When an average particle diameter of the tabular particles such as the talc is too small, a specific surface area of the filler is increased to increase a friction resistance in the case of a contact with the heating unit such as the thermal head. Therefore, a particle diameter of the tabular particles may preferably be larger than that of the spherical particles. On the other hand, when the average particle diameter of the tabular particles is too large, it is difficult to disperse the tabular particles such as the talc into a coating liquid, thereby causing sedimentation of particles. Further, when the average particle diameter of the tabular particles is too large, a specific surface area of the filler is reduced to make it difficult to attain a satisfactory cleaning effect. Therefore, as the tabular particles, those having an average particle diameter of 1.0 μm or more and 10.0 μm or less may preferably be used. As used herein, the average particle diameter means a number average particle diameter (D50) of primary particles when measured by employing a laser diffraction method.

Further, when an amount of the filler to be added to the heat resistant smooth layer 130 is too large, the filler tends to sediment in the coating liquid, thereby making it difficult to apply the coating liquid for the heat resistant smooth layer 130 and to increase friction. Therefore, it is preferable to appropriately adjust the amount of the filler to be added. More specifically, the amount of the filler to be added to the heat resistant smooth layer 130 may preferably be 5.0 mass % or less.

As described above, according to the thermal transfer sheet according to the preferred embodiment of the present disclosure, any treatment such as aging is not necessarily performed when forming the heat resistant smooth layer 130. Further, the heat resistant smooth layer 130 is excellent in heat resistance and film formation property, is capable of stably realizing a low friction coefficient within a range of temperatures of heating by the heating unit such as the thermal head, does not exert any adverse influence on the thermal transfer dye layer 120 without heating unit contamination, and is excellent in storage stability.

<2. Method for Producing Thermal Transfer Sheet>

The configuration of the thermal transfer sheet according to one preferred embodiment of the present disclosure is described above, and, hereinafter, a method for producing the thermal transfer sheet according to one preferred embodiment of the present disclosure will be described.

[2-1. Formation of Heat Resistant Smooth Layer 130]

A coating liquid for the heat resistant smooth layer 130 is prepared by dissolving or dispersing the additives such as the above-described binder, lubricant, filler, and isocyanate into a predetermined solvent. As the binder, the binder obtainable by mixing the polyvinyl acetoacetal resin with the acryl silicone resin which has a mass average molecular weight of 100,000 or more and is in the form of a powdery solid at an ordinary temperature is used. Further, an addition amount of the acryl silicone resin is such that the acryl silicone resin is contained at a ratio of 10 parts by mass or less relative to 100 parts by mass of the polyvinyl acetoacetal resin in the heat resistant smooth layer 130 after the formation (curing) of the heat resistant smooth layer 130. Further, an amount of isocyanate is such that the isocyanate is contained at a ratio of 10 parts by mass or more and 30 parts by mass or less relative to 100 parts by mass of the polyvinyl acetoacetal resin in the heat resistant smooth layer 130 after the formation (curing) of the heat resistant smooth layer 130. A type of the solvent and a mass ratio between the additives and the solvent may appropriately be decided such that the additives are satisfactorily dissolved or dispersed into the solvent.

The coating liquid is applied onto one surface of the above-described base sheet 110 by employing a gravure printing method, a screen printing method, a reverse roll coating method using a gravure plate, or the like, for example, followed by drying. Drying conditions are not particularly limited and can appropriately be set such that the solvent used for dissolving the binder, lubricant, filler, and the like is volatilized. The heat resistant smooth layer 130 is formed in such a manner. A so-called aging treatment is not necessary for forming the heat resistant smooth layer 130 according to the present embodiment. The heat resistant smooth layer 130 may preferably be formed such that a thickness thereof when dried is from 0.1 to 5 μm. When the thickness of the heat resistant smooth layer 130 is too large, it is difficult to project the filler from the surface of the heat resistant smooth layer 130, thereby making it difficult to impart the smoothing property and raising a risk of powder generation or the like.

[2-2. Formation of Thermal Transfer Dye Layer 120]

Next, a coating liquid for the thermal transfer dye layer 120 is prepared by adding the dye, the binder, and other additives to be added as required to a predetermined solvent and dissolving or dispersing the components. The type of the solvent and a mass ratio between the dye, binder, and additives and the solvent may appropriately be decided so that the additives are satisfactorily dissolved or dispersed into the solvent.

The coating liquid is applied onto a surface of the base sheet 110, which is reverse to the surface on which the heat resistant smooth layer 130 is formed as described above, followed by drying. As the coating method, a known method such as a gravure printing method, a screen printing method, and a reverse roll coating method using a gravure plate may be employed. Drying conditions are not particularly limited and can appropriately be set so that the solvent used for dissolving the dye, binder, and the like is volatilized. The thermal transfer dye layer 120 is formed as described above. It is preferable to form the thermal transfer dye layer 120 such that a thickness thereof when dried is 0.1 to 5.0 μm, particularly preferably 0.1 to 3.0 μm. Further, as the thermal transfer dye layer 120, dye layers of a plurality of color phases of yellow, magenta, cyan, black, and the like may sequentially be formed or a dye layer of a single color phase may be formed on an entire part of the surface of the base sheet 110.

Though the example of forming the thermal transfer dye layer 120 after forming the heat resistant smooth layer 130 is given in the above description, the order of formation of the heat resistant smooth layer 130 and the thermal transfer dye layer 120 is not particularly limited. More specifically, the heat resistant smooth layer 130 may be formed after forming the thermal transfer dye layer 120 in the reverse order from that described above. It is possible to realize a one-path line production in the method for producing the thermal transfer sheet 100 according to the present embodiment due to the elimination of aging treatment.

EXAMPLES

Hereinafter, the present disclosure will be described in more details by using examples to which the present disclosure is adopted.

[Material for Heat Resistant Smooth Layer]

In the following examples and comparative examples, the following compounds 1 to 6 are used as the binders, the following compounds 7 and 9 are used as the lubricants, the compound 10 is used as the isocyanate (thermal crosslinking agent), and the following compounds 11 and 12 are used the fillers. The compound 9 is obtainable by separating and extracting monoester from "Phoslex A-18" manufactured by SC Organic Chemical Co., Ltd., in which C18 alkyl chain monoester and diester are contained at a ratio of 1.7:1 (mass ratio).

<Binder (Polyvinyl Acetal Resin)>

Compound 1: Polyvinyl Acetoacetal Resin (product of Sekisui Chemical Co., Ltd., trade name: KS-3Z, Tg: 110° C.)

Compound 2: Polyvinyl Acetoacetal Resin (product of Sekisui Chemical Co., Ltd., trade name: KS-1, Tg: 107° C.)

Compound 3

(product of Sekisui Chemical Co., Ltd., trade name: BX-1, Tg: 90° C.)

<Binder (Acryl Silicone Resin)>

Compound 4

(product of Nissin Chemical Co., Ltd., trade name: R-170, in the form of a solid, Mw: 250,000 to 300,000, volatile matter content (impurities): 5 mass % or less, acid value: 0.06 KOH/g, hydroxide group value: 0.1 mgKOH/g)

Compound 5

(product of Toagosei Co., Ltd., trade name: Simac US-270, 30 mass % MEK-TOL solution, Mw: less than 100,000, acid value: 26 KOH/g, hydroxide group value: 0 mgKOH/g)

Compound 6

(product of Toagosei Co., Ltd., trade name: Simac US-380, 30 mass % MEK-TOL solution, Mw: less than 100,000, acid value: 0 KOH/g, hydroxide group value: 65 mgKOH/g)

<Lubricant (Phosphoric Acid Ester)>

Compound 7

(product of Toho Chemical Industry Co., Ltd., trade name: GF-199, melting point: 44° C.)

Compound 8

(product of Toho Chemical Industry Co., Ltd., trade name: RL-210, melting point: 55° C.)

Compound 9: Monooctadecyl Phosphate (purity: 94.2%, melting point: 82° C.)

<Crosslinking Agent (Isocyanate)>

Compound 10

(product of Nippon Polyurethane Industry Co., Ltd., trade name: Coronate L, 45 mass % ethyl acetate solution)

<Filler>

Compound 11: Spherical Particles of Polymethyl Silsesquioxane (Product of Toshiba Silicone Co., Ltd., trade name: XC-99, average particle diameter: 0.7 μm)

Compound 12: Talc (product of Nippon Talc Co., Ltd., trade name: SG-95, average particle diameter: 2.5 μm)

[Production of Thermal Transfer Sheet]

(Formation of Heat Resistant Smooth Layer)

A thermal transfer sheet was produced by the following method by using the above-described compounds. A polyester film (product of Toray Industries, Inc., trade name: Lumilar) having a thickness of 6 μm was used as the base sheet. As the binder, lubricant, and filler for the heat resistant smooth layer, each of the compounds shown in Table 1 was used such that amounts thereof to be contained in the heat resistant smooth layers after the formation become the amounts shown in Table 1. The binder, lubricant, and filler were dissolved into 1900 parts by mass of a mixture solvent of methylethylketone and toluene (mixture ratio: methylethylketone:toluene=1:2) to prepare a coating liquid for the heat resistant smooth layer. The coating liquid was applied onto one surface of the above-described base sheet such that a thickness after drying was 0.5 μm and then dried. Thus, the heat resistant smooth layers of Example 1 to Example 8 and Comparative Example 1 to Comparative Example 8 shown in Table 1 were obtained.

In Table 1, in addition to the types and the contents of the binders, the lubricants and the fillers in the heat resistant smooth layers, contents of the isocyanate in the heat resistant smooth layers after the formation are shown. Further, each of the contents of the binders, the lubricants and the fillers and contents of isocyanate in the heat resistant smooth layers in Table 1 is a mass ratio of the amount to be contained in the heat resistant smooth layer after the formation.

TABLE 1

| | Type of binder | Content of binder (mass %) | Content of acryl silicone resin (mass %) | Type of lubricant | Content of lubricant (mass %) | Content of isocyanate (mass %) | Type of filler | Content of filler (mass %) |
|---|---|---|---|---|---|---|---|---|
| Example 1 | Compound 1 | 100 | | Compound 8 | 20 | 10 | Compound 11 | 1 (0.75) |
| | Compound 4 | 2 | 2 | | | | | |
| Example 2 | Compound 1 | 100 | | Compound 8 | 20 | 20 | Compound 11 | 1 (0.69) |
| | Compound 4 | 2 | 2 | | | | | |
| Example 3 | Compound 1 | 100 | | Compound 8 | 20 | 30 | Compound 11 | 1 (0.65) |
| | Compound 4 | 2 | 2 | | | | | |

TABLE 1-continued

| | Type of binder | Content of binder (mass %) | Content of acryl silicone resin (mass %) | Type of lubricant | Content of lubricant (mass %) | Content of isocyanate (mass %) | Type of filler | Content of filler (mass %) |
|---|---|---|---|---|---|---|---|---|
| Example 4 | Compound 1 | 50 | | Compound 8 | 20 | 20 | Compound 11 | 1 (0.69) |
| | Compound 2 | 50 | | | | | | |
| | Compound 4 | 2 | 2 | | | | | |
| Example 5 | Compound 1 | 50 | | Compound 8 | 10 | 20 | Compound 11 | 1 (0.69) |
| | Compound 2 | 50 | | Compound 9 | 10 | | | |
| | Compound 4 | 2 | 2 | | | | | |
| Example 6 | Compound 1 | 50 | | Compound 8 | 20 | 20 | Compound 11 | 1 (0.69) |
| | Compound 2 | 50 | | | | | Compound 12 | 1 (0.69) |
| | Compound 4 | 2 | 2 | | | | | |
| Example 7 | Compound 1 | 100 | | Compound 8 | 20 | 20 | Compound 11 | 1 (0.70) |
| | Compound 4 | 0.5 | 0.5 | | | | | |
| Example 8 | Compound 1 | 100 | | Compound 8 | 20 | 20 | Compound 11 | 1 (0.66) |
| | Compound 4 | 10 | 10 | | | | | |
| Comparative | Compound 3 | 100 | | Compound 8 | 20 | 20 | Compound 11 | 1 (0.69) |
| Example 1 | Compound 4 | 2 | 2 | | | | | |
| Comparative | Compound 1 | 100 | | Compound 8 | 20 | 5 | Compound 11 | 1 (0.78) |
| Example 2 | Compound 4 | 2 | 2 | | | | | |
| Comparative | Compound 1 | 100 | | Compound 8 | 20 | 40 | Compound 11 | 1 (0.61) |
| Example 3 | Compound 4 | 2 | 2 | | | | | |
| Comparative | Compound 1 | 100 | | Compound 7 | 20 | 20 | Compound 11 | 1 (0.69) |
| Example 4 | Compound 4 | 2 | 2 | | | | | |
| Comparative Example 5 | Compound 1 | 100 | — | Compound 8 | 20 | 20 | Compound 11 | 1 (0.70) |
| Comparative | Compound 1 | 100 | | Compound 8 | 20 | 20 | Compound 11 | 1 (0.64) |
| Example 6 | Compound 4 | 15 | 15 | | | | | |
| Comparative | Compound 1 | 100 | | Compound 8 | 20 | 20 | Compound 11 | 1 (0.69) |
| Example 7 | Compound 5 | 2 | 2 | | | | | |
| Comparative | Compound 1 | 100 | | Compound 8 | 20 | 20 | Compound 11 | 1 (0.69) |
| Example 8 | Compound 6 | 2 | 2 | | | | | |

(Formation of Thermal Transfer Dye Layer)

Next, immediately after the formation of the heat resistant smooth layers of Examples 1 to 8 and Comparative Examples 1 to 8, a three-color thermal transfer dye layer of the following composition was coated on a surface which is reverse to of the surface on which the heat resistant smooth layer was formed in such a manner that a thickness thereof after drying became 1 μm, followed by drying, thereby obtaining a thermal transfer dye layer. As described above, thermal transfer sheets of Examples 1 to 8 and Comparative Examples 1 to 8 each having the thermal transfer dye layer on one surface of the base sheet and the heat resistant smooth layer on the other surface were produced. A drying temperature for the formation of the heat resistant smooth layer and the thermal transfer dye layer was 105° C., and a drying period inducing the drying period in the heat resistant smooth layer coating was 30 seconds.

<Yellow Color Dye Layer>

Foron yellow (product of Sandoz): 5.0 parts by mass

Polyvinyl butyral resin (product of Sekisui Chemical Co., Ltd., trade name: BX-1): 5.0 parts by mass Methylethylketone: 45.0 parts by mass Toluene: 45.0 parts by mass <Magenta Color Dye Layer>

Foron red: 2.5 parts by mass

Anthraquinone dye (product of Sumitomo Chemical Co., Ltd., trade name: ESC451): 2.5 parts by mass Polyvinyl butyral resin (product of Sekisui Chemical Co., Ltd., trade name: BX-1): 5.0 parts by mass Methylethylketone: 45.0 parts by mass Toluene: 45.0 parts by mass <Cyan Color Dye Layer>

Foron blue (product of Sandoz): 2.5 parts by mass

Indoaniline dye (see the following Structural Formula 1): 2.5 parts by mass

Polyvinylal resin (product of Sekisui Chemical Co., Ltd., trade name: BX-1): 5.0 parts by mass Methylethylketone: 45.0 parts by mass Toluene: 45.0 parts by mass (Structural Formula 1)

[Chem. 1]

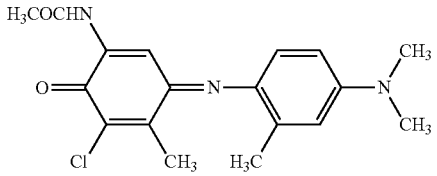

[Evaluation of Thermal Transfer Sheet]

A friction coefficient, running smoothness, sticking, dye storage stability, and thermal head contamination of each of the thermal transfer sheets of Examples 1 to 11 and Comparative Examples 1 to 9 produced as described above were evaluated.

(Evaluation of Friction Coefficient)

Figure 6:
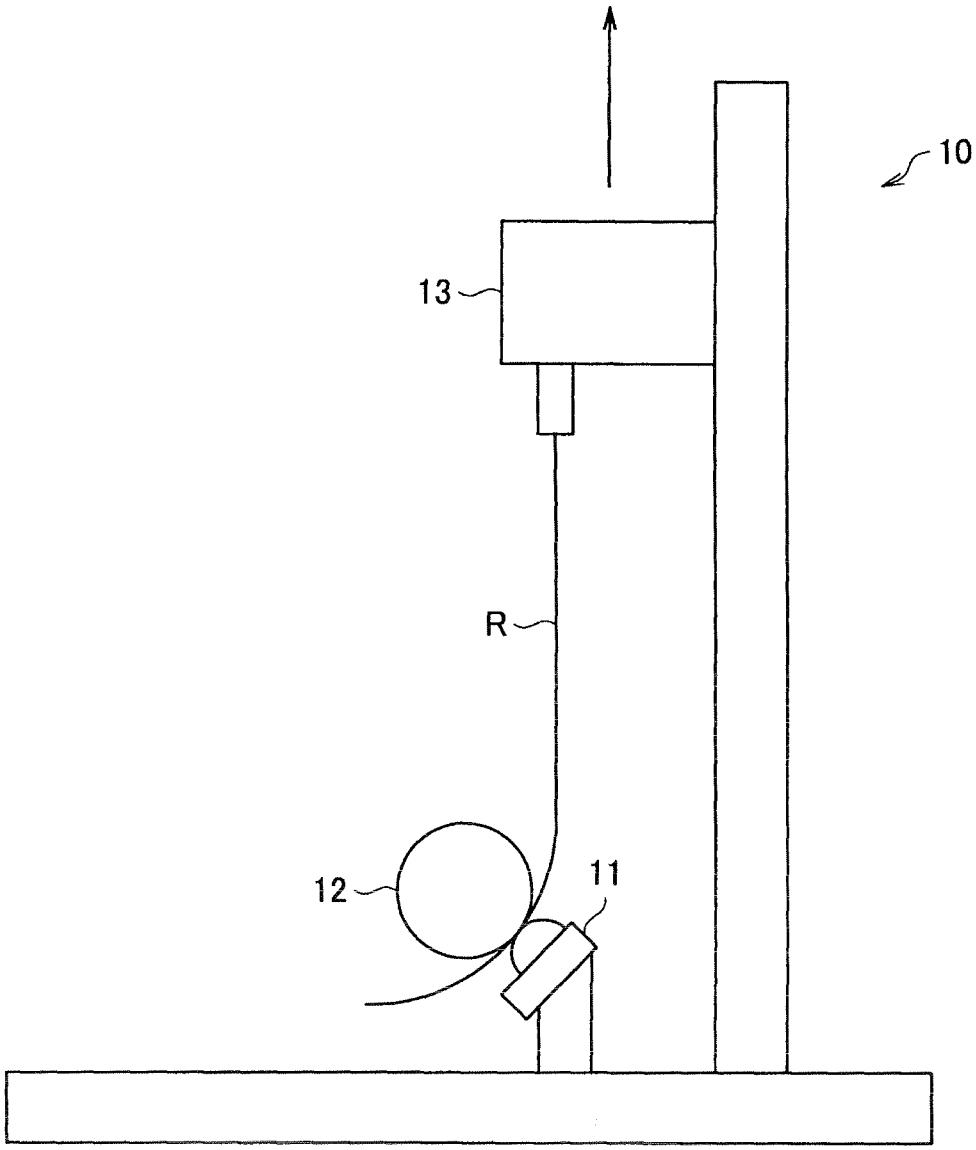
FIG. 6 is an explanatory diagram schematically illustrating a configuration of a friction measurement device used in Examples.

The friction coefficient was measured by using a friction measurement device 10 shown in FIG. 6. The friction measurement device 10 is configured to measure a tension by holding the thermal transfer sheet 100 and a printing paper R between a thermal head 11 and a platen roll 12 and pulling up the thermal transfer sheet 100 and the printing paper with the use of a tension gauge 13. Measurement conditions were as follows.

<Measurement Conditions>

Thermal transfer sheet feeding speed: 450 mm/min

Signal settings

Printing pattern: 2 (Stair Step)
Original document: 3 (48/672 lines, 14 steps)
Strobe division: 1
Strobe pulse width: 20.0 msec
Printing speed: 22.0 msec/line
Clock: 3 (4 MHz)
Head voltage: 18.0 V (Evaluations of Running Smoothness and Thermal Head Contamination)

The running smoothness and thermal head contamination were evaluated by employing the method described below. More specifically, the thermal sheet obtained as described above was mounted on a full-color printer manufactured by Sony Corporation (trade name: UP-DR150), and gradation printing (16 gradations) on a printing paper (product of Sony Corporation, trade name: UPC-R154H) was performed to examine the running smoothness (printing irregularity, crumpling, printing displacement, running noise, and the like) and thermal head contamination.

As to the running smoothness, the thermal transfer sheet which was free from the printing irregularity, crumpling, and the like was evaluated as ○, and the thermal transfer sheet in which the printing irregularity, crumpling, and the like were observed was evaluated as ×.

As to the thermal head contamination, a surface of the thermal head was observed with an optical microscope after repeating the gradation printing for 10000 times, and the thermal transfer sheet with a good result was evaluated as ○, while the thermal transfer sheet by which a deposit was observed and the thermal head was contaminated was evaluated as ×.

(Evaluation of Dye Storage Stability)

As to the dye storage stability, two sheets of each of the above-obtained thermal transfer sheets were used, and the thermal transfer dye layer and the heat resistant smooth layer of the two thermal transfer sheets (20 cm×20 cm) were overlapped with each other. The overlapped thermal transfer sheets were held between two glass plates, and placed in a 50° C. oven for 2 weeks with a weight of 5 kg being applied thereto. Each of the thermal transfer sheets before and after the storage was mounted to a full-color printer manufactured by Sony Corporation (trade name: UP-DR150), and gradation printing (16 gradations) on a printing paper (product of Sony Corporation, trade name: UPC-R154H) was performed to measure color differences among the gradations in terms of chromaticity in a L*a*b* color system by a Macbeth spectral color checker (trade name: SpectroEye). Next, a color phase ΔEab was calculated from the measured chromaticity to evaluate the dye storage stability as the color shift. More specifically, the color shift of ΔEab≤4.5 was evaluated as ○, and the color shift of ΔEab>4.5 was evaluated as ×. Further, a friction coefficient of the heat resistant smooth layer of each of the obtained thermal transfer sheets after being stored at a 50° C. oven for 2 weeks was measured to confirm the friction coefficient after the storage at high temperature.

The results of the above-described evaluations are shown in Table 2 below. As to the friction coefficient in Table 2, a minimum value (min) and a maximum value (max) thereof are shown. Further, "initial friction coefficient" in Table 2 means a friction coefficient which was measured without storing the thermal transfer sheet, and "friction coefficient after storage" means the friction coefficient which was measured after the high temperature storage.

TABLE 2

| | Initial friction coefficient (min) | Initial friction coefficient (max) | Running smoothness | Initial friction coefficient after storage (min) | Initial friction coefficient after storage (max) | Δ Eab | Color shift | Contamination of thermal head |
|---|---|---|---|---|---|---|---|---|
| Example 1 | 0.21 | 0.25 | ○ | 0.22 | 0.26 | 3.8 | ○ | ○ |
| Example 2 | 0.2 | 0.24 | ○ | 0.21 | 0.26 | 3.5 | ○ | ○ |
| Example 3 | 0.19 | 0.25 | ○ | 0.2 | 0.26 | 3.2 | ○ | ○ |
| Example 4 | 0.18 | 0.24 | ○ | 0.2 | 0.26 | 3.4 | ○ | ○ |
| Example 5 | 0.2 | 0.25 | ○ | 0.21 | 0.27 | 3 | ○ | ○ |
| Example 6 | 0.17 | 0.25 | ○ | 0.2 | 0.27 | 3.5 | ○ | ○ |
| Example 7 | 0.23 | 0.27 | ○ | 0.25 | 0.29 | 3.3 | ○ | ○ |
| Example 8 | 0.17 | 0.23 | ○ | 0.2 | 0.24 | 4.4 | ○ | ○ |
| Comparative Example 1 | 0.2 | 0.25 | ○ | 0.21 | 0.26 | 5 | X | ○ |
| Comparative Example 2 | 0.22 | 0.27 | ○ | 0.25 | 0.29 | 5.2 | X | ○ |
| Comparative Example 3 | 0.21 | 0.25 | ○ | 0.22 | 0.27 | 5 | X | ○ |
| Comparative Example 4 | 0.19 | 0.24 | ○ | 0.22 | 0.26 | 5.3 | X | ○ |
| Comparative Example 5 | 0.25 | 0.29 | X | 0.28 | 0.32 | 3.4 | ○ | ○ |
| Comparative Example 6 | 0.18 | 0.3 | X | 0.24 | 0.32 | 5.8 | X | ○ |
| Comparative Example 7 | 0.24 | 0.28 | ○ | 0.25 | 0.3 | 4.7 | X | ○ |
| Comparative Example 8 | 0.22 | 0.27 | ○ | 0.24 | 0.28 | 5 | X | ○ |

As is understood from the results shown in Table 2, good running smoothness, low friction, and a clear image were attained in each of the Example 1 to Example 8. Further, since the friction coefficient after storage was not changed so much from the friction coefficient before storage, it was confirmed that the running smoothness after the storage at 50° C. for one week was satisfactory in Example 1 to Example 8. Further, since the color shift was very small in Example 1 to Example 8, it was confirmed that the dye storage stability was satisfactory. As to the thethial head contamination, by the observation of the thermal head in each of Example 1 to Example 8, it was confirmed that contamination did not occur on the surface of thermal head and that the surface of the thermal head was not scraped. Therefore, it was confirmed that the thermal transfer sheet enables to obtain a good image without exerting any adverse influence on the repeated printing.

In contrast, in Comparative Example 1, though the good results were attained as to the friction coefficient and the thermal head contamination, it was confirmed that the change in color phase was large, and the color shift occurred. Further, in Comparative Example 2 similarly, though the evaluations of the friction coefficient and the thermal head contamination were good, the color shift occurred. Transfer of the dye was found by visual observation of the heat resistant smooth layer, and it was confirmed that the transfer of dye was the cause of the color shift.

In Comparative Example 3, a color shift occurred, too, and a blocking track was confirmed on a surface of the heat resistant smooth layer. In view of the blocking track, measurement of isocyanate in the heat resistant smooth layer was performed by using Fourier conversion infrared spectrophotometer to confirm residual isocyanate, and it was confirmed that the heat resistant smooth layer was not sufficiently cured.

In Comparative Example 4, though the friction was low, the change in color phase was large, and the color shift occurred.

In Comparative Example 5, though the initial friction coefficient and running smoothness were satisfactory, the friction coefficient was a little increased after the storage at a high temperature for the evaluation of dye storage stability. The running smoothness per se of the thermal transfer sheet was satisfactory.

In Comparative Example 6, the difference between the minimum value and the maximum value of the friction coefficient was large, and slight abnormal noise was confirmed during running. Further, the change in color phase was large, and the color shift occurred.

In Comparative Examples 7 and 8, the friction coefficient and the running smoothness were satisfactory, but it was confirmed that the color shift due to the evaluation of dye storage stability was a little large. Other properties were satisfactory.

In view of the above results, it is confirmed that it is possible to omit the aging step in the production and to diminish the coefficient of friction with the heating unit such as the thermal head when the heat resistant smooth layer of the thermal transfer sheet has the following configurations (A) and (B). Further, it is confirmed that it is possible to attain the suppression of influence to be exerted by the storage environment on the friction, the good running smoothness, and the good dye storage stability and to obtain a good image when the heat resistant smooth layer of the thermal transfer sheet has the following configurations (A) and (B):

(A) containing, as a binder, the binder obtainable by mixing the polyvinyl acetoacetal resin with the acryl silicone resin which has a mass average molecular weight of 100,000 or more and is in the form of a powdery solid at an ordinary temperature at a ratio of 10 parts by mass or less of the acryl silicone resin relative to 100 parts by mass of the polyvinyl acetoacetal resin; and (B) containing 10 parts by mass or more and 30 parts by mass or less of isocyanate relative to 100 parts by mass of the polyvinyl acetoacetal resin.

It should be understood by those skilled in the art that various modifications, combinations, sub-combinations and alterations may occur depending on design requirements and other factors insofar as they are within the scope of the appended claims or the equivalents thereof.

The present disclosure contains subject matter related to that disclosed in Japanese Priority Patent Application JP 2011-014309 filed in the Japan Patent Office on Jan. 26, 2011, the entire content of which is hereby incorporated by reference.

What is claimed is:

1. A thermal transfer sheet comprising:

a thermal transfer dye layer formed on one surface of a base sheet and containing a dye; and a heat resistant smooth layer formed on the other surface of the base sheet and containing:

a binder;

a lubricant; and a filler;

wherein the binder contained in the heat resistant smooth layer is obtained by mixing a polyvinyl acetoacetal resin with an acryl silicone resin, which has a mass average molecular weight of 100,000 or more and is in the form of a powdery solid at an ordinary temperature, at a ratio of 10 parts by mass or less of the acryl silicone resin relative to 100 parts by mass of the polyvinyl acetoacetal resin; and wherein the heat resistant smooth layer further contains:

10 parts by mass or more and 30 parts by mass or less of an isocyanate relative to 100 parts by mass of the polyvinyl acetoacetal resin; and a phosphoric acid ester having a melting point of 50° C. or more as the lubricant.

2. The thermal transfer sheet according to claim 1;

wherein the filer of the heat resistant smooth layer contains spherical particles containing polymethyl silsesquioxane or a mixture of the spherical particles containing polymethyl silsesquioxane and talc which is tabular particles.

* * * * *